US008261572B2

(12) United States Patent
Nojima et al.

(10) Patent No.: US 8,261,572 B2
(45) Date of Patent: Sep. 11, 2012

(54) FOOD HEAT-EXCHANGE DEVICE AND REFRIGERATOR HAVING THE SAME

(75) Inventors: Hideo Nojima, Seongnam-si (KR); Masaji Yamanaka, Suwon-si (KR); Kyung Hee Hahm, Seoul (KR); Jin Jeong, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 566 days.

(21) Appl. No.: 12/458,380

(22) Filed: Jul. 9, 2009

(65) Prior Publication Data

US 2010/0071874 A1 Mar. 25, 2010

(30) Foreign Application Priority Data

Sep. 22, 2008 (KR) ..... 10-2008-0092785

(51) Int. Cl.
*F25D 17/06* (2006.01)

(52) U.S. Cl. ..... 62/419; 62/441

(58) Field of Classification Search ..... 62/440, 62/419, 441, 382, 407, 434; 165/61, 256; 312/408, 215, 228.1; 454/105, 140
See application file for complete search history.

(56) References Cited

U.S. PATENT DOCUMENTS

| | | | | |
|---|---|---|---|---|
| 3,040,539 | A * | 6/1962 | Gaugler | 62/3.6 |
| 3,766,976 | A * | 10/1973 | Gelbard et al. | 165/122 |
| 3,977,853 | A * | 8/1976 | Eber | 62/491 |
| 4,738,113 | A * | 4/1988 | Rudick | 62/3.5 |
| 5,319,937 | A * | 6/1994 | Fritsch et al. | 62/3.62 |
| 6,301,901 | B1 * | 10/2001 | Coffee et al. | 62/3.7 |
| 6,408,941 | B1 * | 6/2002 | Zuo | 165/165 |
| 6,601,642 | B1 * | 8/2003 | Randall | 165/86 |
| 7,609,477 | B2 * | 10/2009 | Atarashi et al. | 360/97.02 |
| 7,682,690 | B2 * | 3/2010 | Bunyan et al. | 428/323 |
| 2002/0047506 | A1 * | 4/2002 | George | 312/408 |
| 2005/0218767 | A1 * | 10/2005 | Jeong et al. | 312/408 |
| 2007/0102148 | A1 * | 5/2007 | Giacomel | 165/185 |

FOREIGN PATENT DOCUMENTS

| | | |
|---|---|---|
| KR | 10-2006-0070253 | 6/2006 |
| KR | 10-2006-0101988 | 9/2006 |

* cited by examiner

*Primary Examiner* — Mohammad Ali
(74) *Attorney, Agent, or Firm* — Staas & Halsey LLP

(57) ABSTRACT

Disclosed are a food heat-exchange device capable of rapidly freezing food stored in a refrigerator or thawing frozen food in the refrigerator, and a refrigerator having the same. The refrigerator includes a body in which a storage compartment is defined, and the food heat-exchange device is mounted in the storage compartment, to enable thawing or rapid-freezing of food. The food heat-exchange device includes a heat-exchange plate, which is provided at a surface thereof with a contact portion to come into contact with food and at the other surface thereof with a pin to facilitate heat-exchange.

16 Claims, 10 Drawing Sheets

FOOD HEAT-EXCHANGE DEVICE AND REFRIGERATOR HAVING THE SAME

CROSS-REFERENCE TO RELATED APPLICATIONS

This application claims the benefit of Korean Patent Application No. 2008-0092785, filed on Sep. 22, 2008 in the Korean Intellectual Property Office, the disclosure of which is incorporated herein by reference.

BACKGROUND

1. Field

The present invention relates to a food heat-exchange device and a refrigerator having the same, and, more particularly, to a food heat-exchange device, which is provided in a storage compartment of a refrigerator and serves to enable rapid-freezing or thawing of food, and a refrigerator having the same.

2. Description of the Related Art

In general, a refrigerator includes a refrigerating compartment in which food is kept cool at a temperature above zero, and a freezing compartment in which food is frozen and stored at a sub-zero temperature.

The freezing compartment is generally used to store meat, instant food, and long-term storage food. The food stored in the freezing compartment must be thawed prior to being cooked.

"Freezing and storage" is a storage method in which food is frozen and stored at a low temperature of −10° C. or less, to prevent deterioration thereof.

When freezing food, ice is produced in or between cells thereof. On the basis of the fact that ice produced by freezing water has a greater volume than water, if ice crystals are excessively grown, this causes destruction of the cell membrane (tissue), resulting in deterioration in the taste of thawed food.

To solve the above-described problem with relation to freezing, it is necessary to allow food to rapidly pass a specific temperature band (from 0° C. to −5° C.) that increases production of ice crystals.

"Thawing" is to change frozen food to a room-temperature state. In this case, to reduce damage to food, it is desirable to uniformly thaw the exterior and interior of food at a constant low temperature. Specifically, thawing food at a low temperature (from 0° C. to −2° C.) may prevent deterioration in the taste of food and excessive thawing of food.

However, since conventional refrigerators are adapted to indirectly freeze food by lowering a surrounding temperature of the food, it is difficult to allow the food to rapidly pass the specific temperature band from 0° C. to −5° C.

Although the lower the surrounding temperature of food, the faster the thawing rate, refrigeration cycle efficiency is deteriorated in proportion to the lowering of temperature, resulting in increased consumption of power.

Further, although uniformly thawing the exterior and interior of food at a constant low temperature within a refrigerator is ideal to prevent deterioration in the taste thereof, this deteriorates convenience in use due to an increased thawing time.

Furthermore, when a heating source is used to directly provide food with hot air, etc. in order to reduce a thawing time, such forcible thawing disadvantageously increases consumption of power.

SUMMARY

Therefore, it is an aspect of the present invention to provide a food heat-exchange device to enable not only rapid freezing of food stored in a refrigerator, but also thawing of frozen food within the refrigerator, and a refrigerator having the same.

It is another aspect of the present invention to provide a rapid-freezing device to enable rapid-freezing of food with minimized consumption of power and without deterioration in the taste thereof, and a refrigerator having the same.

It is a further aspect of the present invention to provide a thawing device to uniformly thaw the exterior and interior of food at a constant temperature with minimized consumption of power, and a refrigerator having the same.

Additional aspects and/or advantages of the invention will be set forth in part in the description which follows and, in part, will be apparent from the description, or may be learned by practice of the invention.

The foregoing and/or other aspects of the present invention are achieved by providing a food heat-exchange device of a refrigerator, including: a heat-exchange plate installed in the refrigerator and including a contact portion provided at a first surface of the heat-exchange plate to come into contact with food and a pin provided at a second surface of the heat-exchange plate to facilitate heat-exchange.

The food heat-exchange device may further include a blower fan to blow air toward the pin.

The contact portion and the pin may be separated from each other, to prevent the air moved by the blower fan from coming into contact with the food.

The food heat-exchange device may further include a guide member to guide the air moved by the blower fan such that the air is guided in a direction away from the heat-exchange plate after passing through the pin.

The refrigerator may include a refrigerating compartment and a freezing compartment, in which food is stored, and the heat-exchange plate may be mounted in at least one of the refrigerating compartment and freezing compartment.

The foregoing and/or other aspects of the present invention are achieved by providing a refrigerator including: a body defining a storage compartment; and a food heat-exchange device mounted in the storage compartment and used to enable thawing or rapid-freezing of food, wherein the food heat-exchange device includes a heat-exchange plate, the heat-exchange plate including a contact portion provided at a first surface of the heat-exchange device to come into contact with food and a pin provided at a second surface of the heat-exchange device to facilitate heat-exchange.

The food heat-exchange device may further include a blower fan to blow air toward the pin of the heat-exchange plate.

The storage compartment may contain a guide portion to guide entrance and exit of the heat-exchange plate while supporting the heat-exchange plate.

The refrigerator may further include a shelf provided in the storage compartment, and the shelf may include a receptacle in which the heat-exchange plate is received.

The body may include a rapid-freezing chamber or thawing chamber in which the food heat-exchange device is received, the rapid-freezing chamber or thawing chamber being separated from the storage compartment for thawing or rapid-freezing of food.

The food heat-exchange device may further include a guide member to guide the air moved by the blower fan such that the air is guided in a direction away from the heat-exchange plate after passing through the pin.

The storage compartment may include a freezing compartment in which food is frozen and stored, and the food heat-exchange device may be a rapid-freezing device provided in the freezing compartment and used to rapidly freeze food on the contact portion.

The storage compartment may include a refrigerating compartment in which food is kept cool, and the food heat-exchange device may be a thawing device provided in the refrigerating compartment and used to thaw food on the contact portion without a separate heating source.

The foregoing and/or other aspects of the present invention are achieved by providing a refrigerator including: a first storage compartment having a temperature of less than 0° C.; a second storage compartment having a temperature of more than 0° C.; a rapid-freezing plate provided in the first storage compartment and formed, at a first surface thereof, with a contact portion to come into contact with food and at a second surface thereof, with a pin to facilitate heat-exchange; and a thawing plate provided in the second storage compartment and formed, at a first surface thereof, with a contact portion to come into contact with the food and at a second surface thereof, with a pin to facilitate heat-exchange.

The foregoing and/or other aspects of the present invention are achieved by providing a refrigerator including: a variable temperature chamber in which a temperature is variable between a temperature above zero to a temperature below zero; a heat-exchange plate mounted in the variable temperature chamber and formed, at a first surface thereof, with a contact portion to come into contact with food and at a second surface thereof, with a pin to facilitate heat-exchange, wherein the heat-exchange plate is used to thaw the food when the temperature of the variable temperature room is above zero, and to rapidly freeze the food when the temperature of the variable temperature room is below zero.

The refrigerator may further include: a blower fan to blow air toward the pin so as to enhance heat exchange of the heat-exchange plate.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENT

Figure 1:
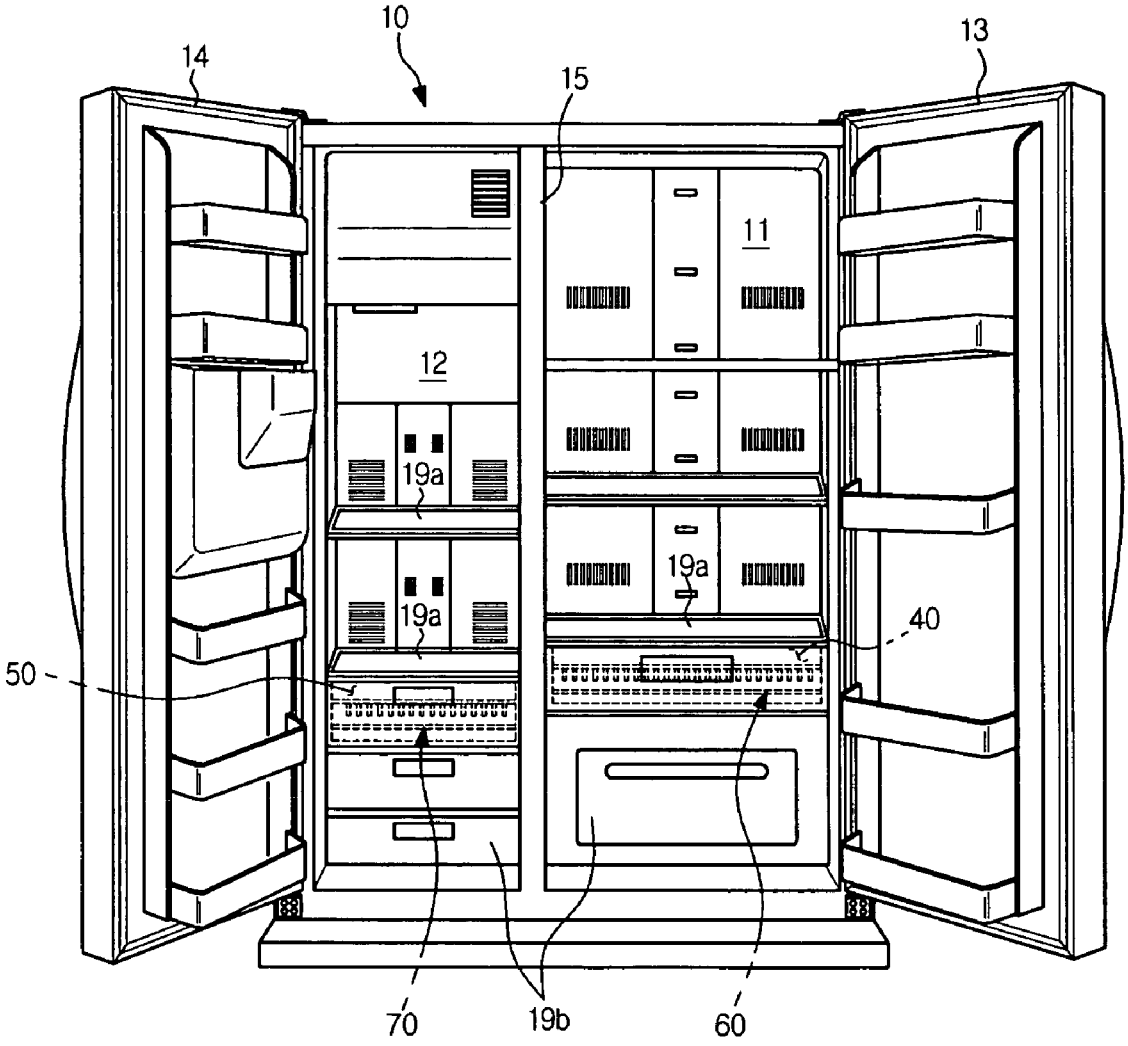
FIG. 1 is a perspective view illustrating the outer appearance of a refrigerator according to an exemplary embodiment of the present invention.

Reference will now be made in detail to an exemplary embodiment of the present invention, an example of which is illustrated in the accompanying drawings, wherein like reference numerals refer to like elements throughout. The embodiment is described below to explain the present invention by referring to the figures.

Figure 2:
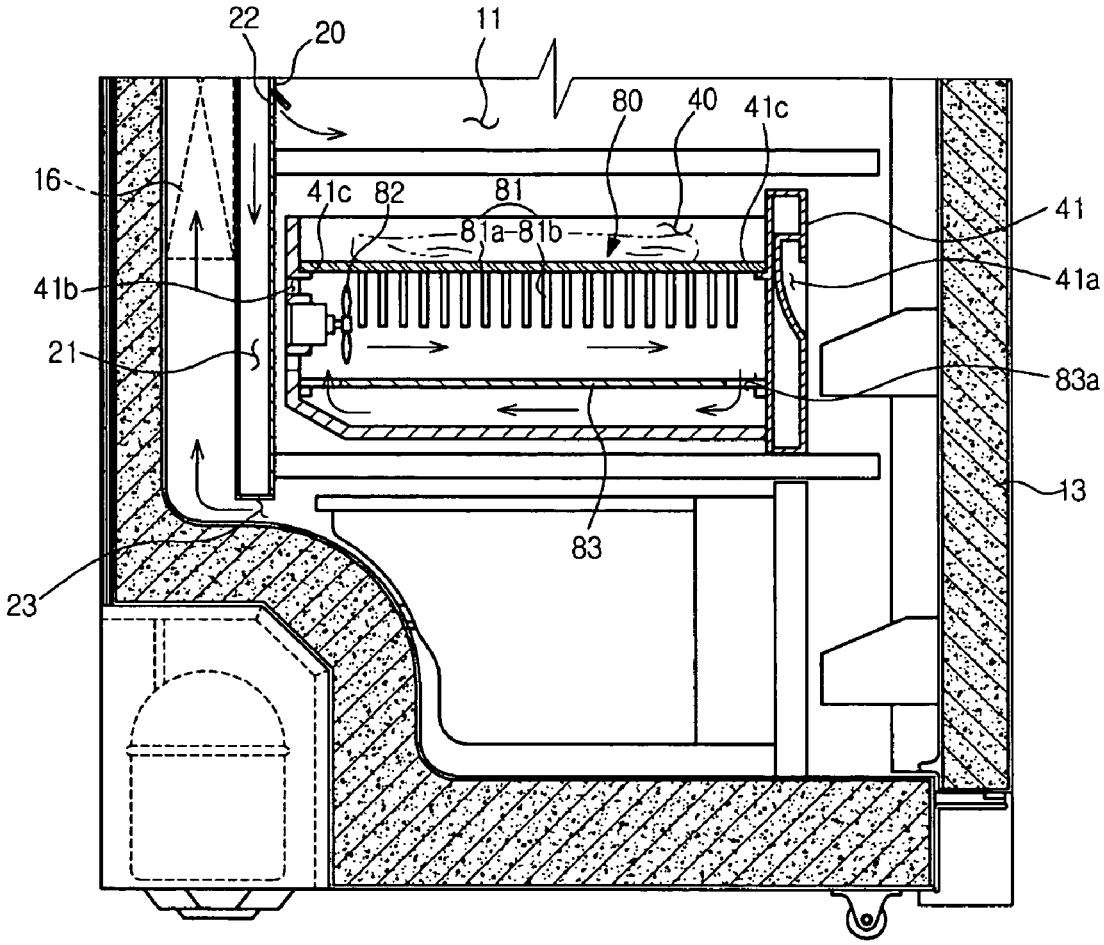
FIG. 2 is a sectional view illustrating a thawing chamber of the refrigerator according to the exemplary embodiment of the present invention.
Figure 3:
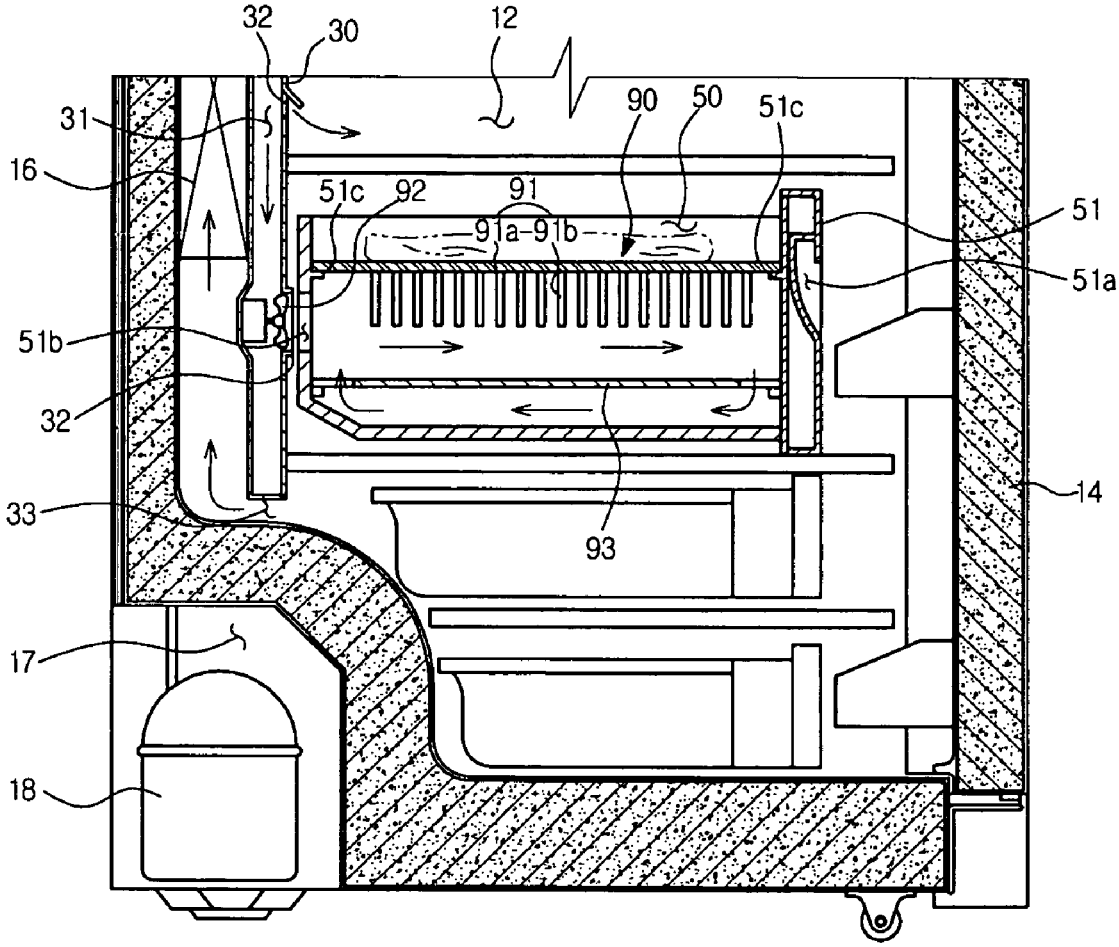
FIG. 3 is a sectional view illustrating a rapid-freezing chamber of the refrigerator according to the exemplary embodiment of the present invention.

FIG. 1 is a perspective view illustrating the outer appearance of a refrigerator according to an exemplary embodiment of the present invention, FIG. 2 is a sectional view illustrating a thawing chamber of the refrigerator according to the exemplary embodiment of the present invention, and FIG. 3 is a sectional view illustrating a rapid-freezing chamber of the refrigerator according to the exemplary embodiment of the present invention.

Figure 4:
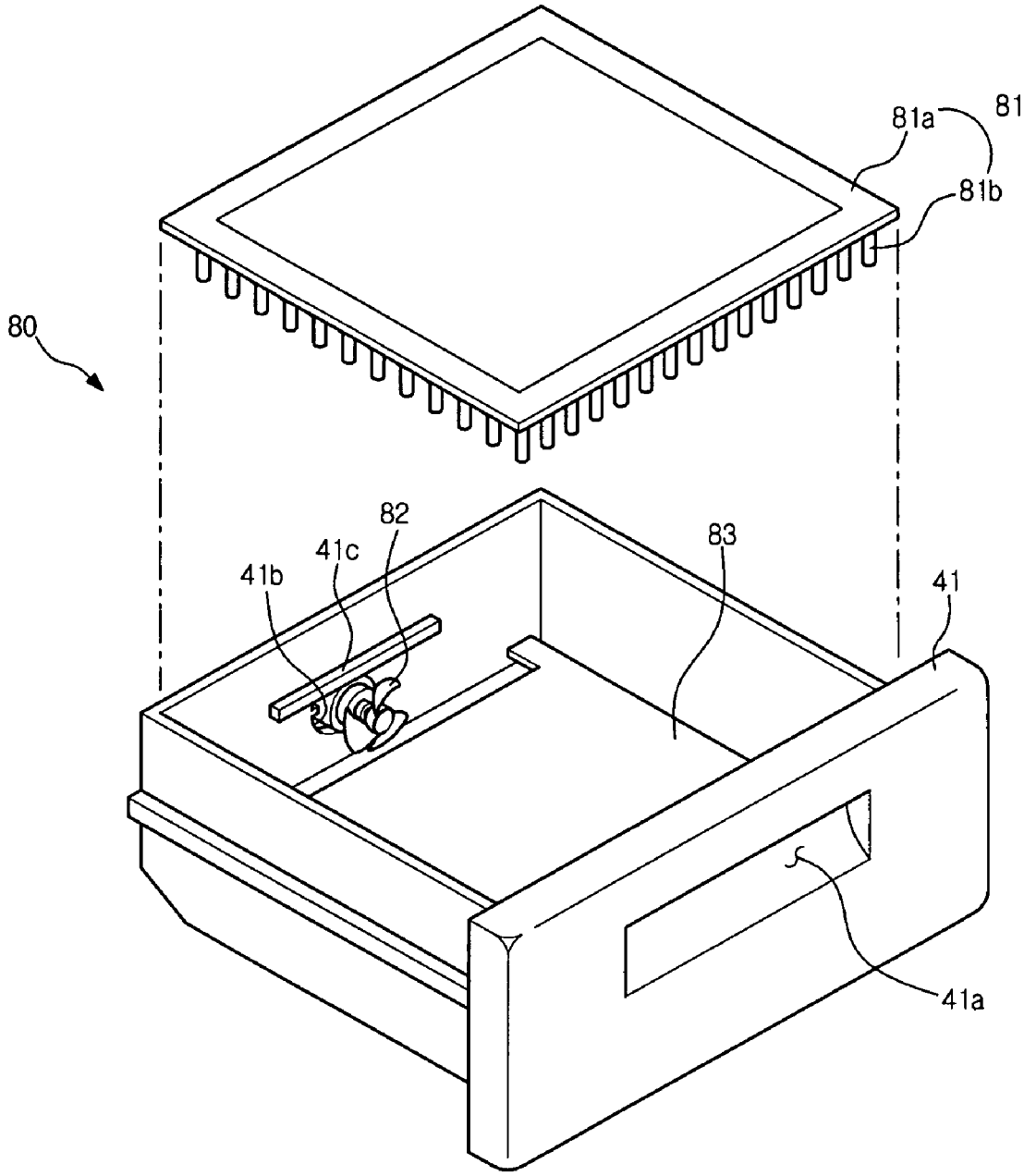
FIG. 4 is an exploded perspective view of the thawing chamber of the refrigerator according to the exemplary embodiment of the present invention.
Figure 5:
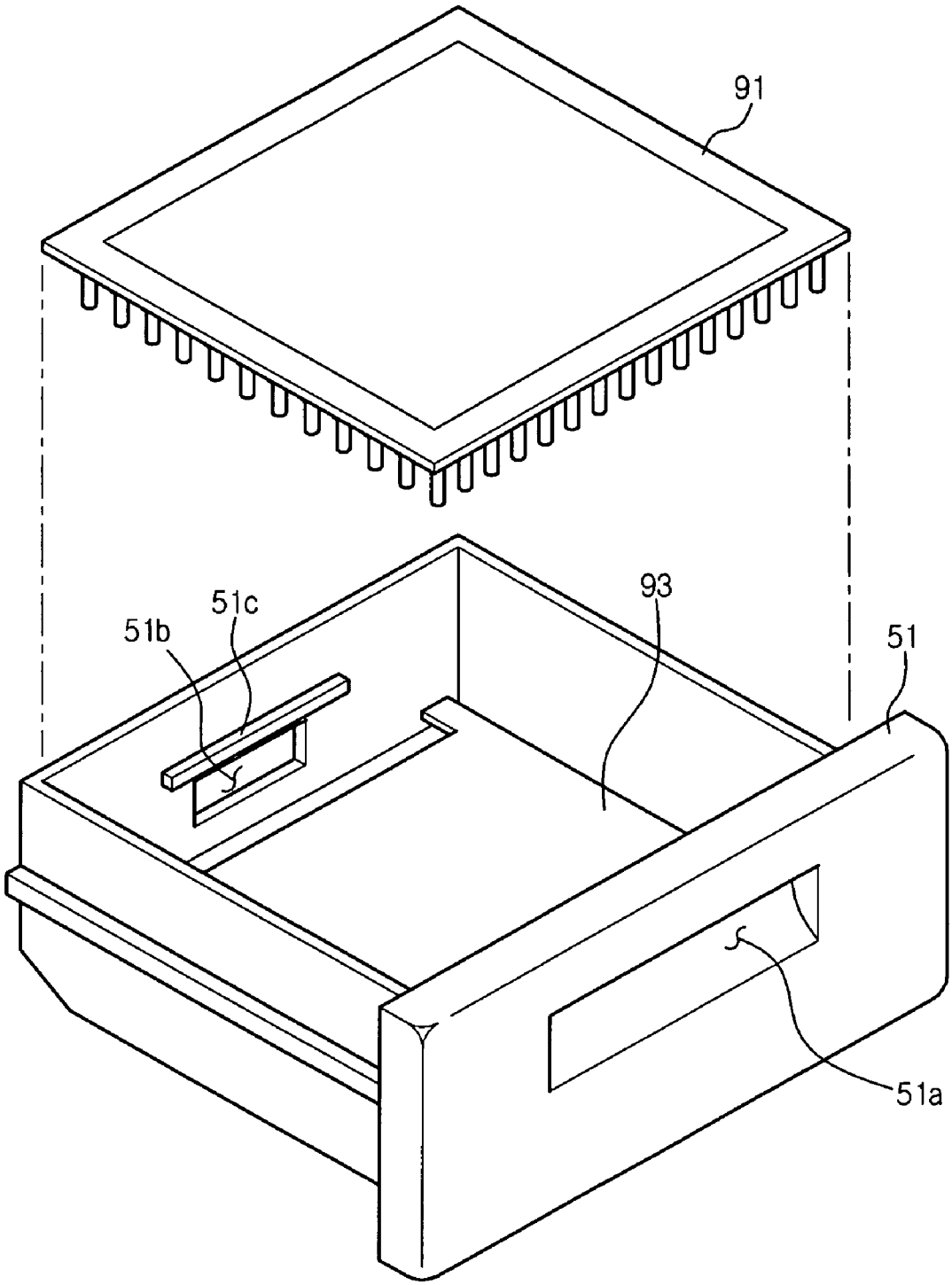
FIG. 5 is an exploded perspective view of the rapid-freezing chamber of the refrigerator according to the exemplary embodiment of the present invention.
Figure 6:
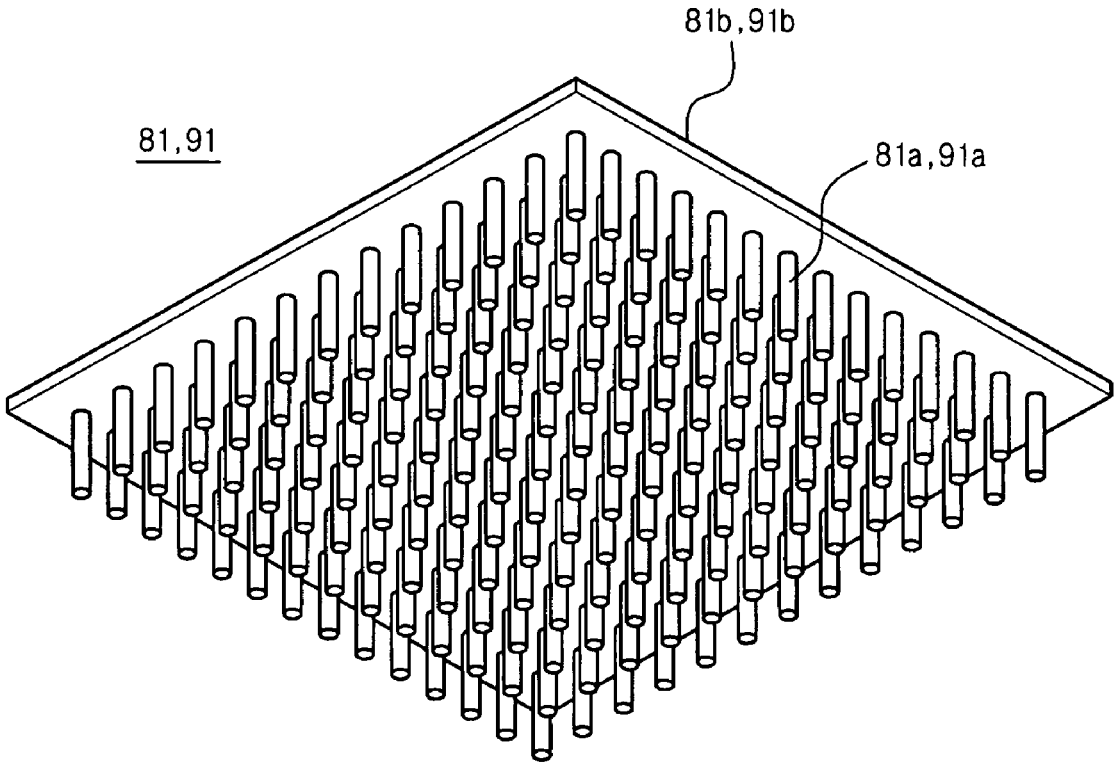
FIG. 6 is a bottom perspective view of a heat-exchange plate according to the exemplary embodiment of the present invention.

Also, FIG. 4 is an exploded perspective view of the thawing chamber of the refrigerator according to the exemplary embodiment of the present invention, FIG. 5 is an exploded perspective view of the rapid-freezing chamber of the refrigerator according to the exemplary embodiment of the present invention, and FIG. 6 is a bottom perspective view of a heat-exchange plate according to the exemplary embodiment of the present invention.

The refrigerator according to the exemplary embodiment, as shown in FIG. 1, includes a body 10 in which storage compartments 11 and 12 having open front sides are defined, and doors 13 and 14 to open or close the storage compartments 11 and 12.

The storage compartments 11 and 12 include a refrigerating compartment 11 and a freezing compartment 12, which are separated from each other by a vertical partition 15. The doors 13 and 14 include a refrigerating compartment door 13 and freezing compartment door 14 to open or close the refrigerating compartment 11 and freezing compartment 12, respectively.

Similar to a conventional refrigerator, in the refrigerator according to the exemplary embodiment, an evaporator 16 to cool the storage compartments 11 and 12 is provided in a rear position of the storage compartments 11 and 12. A machine room 17 is defined in a bottom region of the body 10 such that it is separated from the storage compartments 11 and 12. A compressor 18, a condenser (not shown), a refrigerant expander (not shown), etc. are received in the machine room 17 (See FIG. 3).

As shown in FIG. 2, the refrigerating compartment 11 contains a refrigerating duct 20 installed at a rear position thereof. The refrigerating duct 20 internally defines a refrigerating path 21, and is formed in a front surface thereof with a plurality of first outlets 22 to discharge cold air into the refrigerating compartment 11, the plurality of first outlets 22 being spaced apart from one another by a predetermined distance. The refrigerating duct 20 defines a first inlet 23, through which cold air inside the refrigerating compartment 11 is directed to the evaporator 16.

As shown in FIG. 3, the freezing compartment 12 contains a freezing duct 30 installed at a rear position thereof. The freezing duct 30 internally defines a freezing path 31, and is formed in a front surface thereof with a plurality of second outlets 32 to discharge cold air into the freezing compartment 12, the plurality of second outlets 32 being spaced apart from one another by a predetermined distance. The freezing duct 30 defines a second inlet 33, through which cold air inside the freezing compartment 12 is directed to the evaporator 16.

A plurality of shelves 19*a* are vertically spaced apart from one another in the storage compartments 11 and 12, and drawers 19*b* are provided below the plurality of shelves 19*a*. These shelves 19*a* and drawers 19*b* divide the interior of the storage compartments 11 and 12 into multiple stages, enabling effective utilization of storage space.

A thawing chamber 40 for thawing of food is provided in the refrigerating compartment 11, and a rapid-freezing chamber 50 to rapidly freeze food is provided in the freezing compartment 12.

Although the exemplary embodiment describes the refrigerator as having both the rapid-cooling chamber and the thawing chamber by way of example, of course, providing only one of the rapid-cooling chamber and thawing chamber is also possible.

The thawing chamber 40 is provided with a thawing device 60 to thaw food. The rapid-freezing chamber 50 is provided with a rapid-freezing device 70 to facilitate heat-exchange with food so as to enable rapid-freezing thereof.

In the exemplary embodiment, both the thawing device 60 and the rapid-cooling device 70 are referred to as a food heat-exchange device. That is, the food heat-exchange device functions as the rapid-cooling device 70 when mounted in the rapid-freezing chamber 50, whereas functions as the thawing device 60 when mounted in the thawing chamber 40.

Although the exemplary embodiment describes both the food heat-exchange devices 60 and 70 mounted, respectively, in the thawing chamber 40 and rapid-freezing chamber 50 by way of example, providing only one of the thawing chamber 40 and rapid-freezing chamber 50 with the food heat-exchange device is possible. In this case, according to the user's selection, the food heat-exchange device may be mounted in the rapid-freezing chamber 50 to function as the rapid-freezing device 70, or may be mounted in the thawing chamber 40 to function as the thawing device 60.

Referring to FIGS. 2 and 4, the thawing chamber 40 is separately defined in the refrigerating compartment 11, to temporarily thaw and store food prior to cooling frozen food that was stored in the freezing compartment 12.

The side and bottom of the thawing chamber 40 are defined by a thawing chamber drawer 41 to enable slidable opening/closing of the thawing chamber 40. The top of the thawing chamber 40 may be defined by the shelf 19*a* provided in the refrigerating compartment 11.

The thawing chamber drawer 41 is formed at a front side thereof with a grip portion 41*a*, and at a rear side thereof with a vent hole 41*b* to enable circulation of air between the thawing chamber 40 and the refrigerating compartment 11.

The thawing device 60, provided in the thawing chamber 40, includes a heat-exchange plate 81 to come into contact with food so as to facilitate heat-exchange, a blower fan 82 to enhance heat-exchange performance of the heat-exchange plate 81, and a guide member 83 to guide air moved by the blower fan 82.

The heat-exchange plate 81 may be made of metals having high thermal conductivity. For example, in the present embodiment, the heat-exchange plate 81 is made of aluminum.

An upper surface of the heat-exchange plate 81, as shown in FIGS. 2 and 6, defines a contact portion 81*a* to come into contact with food, and a lower surface of the plate 81 is provided with pins 81*b* to facilitate heat-exchange.

The contact portion 81*a* has an approximately rectangular form suitable to support food thereon. The pins 81*b* take the form of needles protruding downward from a rear side of the contact portion 81*a*.

Here, various numerical values, such as a distance between the plurality of pins 81*b*, a thickness and length of the pins 81*b*, a flow rate of the blower fan 82, etc., may be set on the basis of an experimentally determined optimal heat-exchange efficiency.

The blower fan 82 is provided to enhance heat-exchange efficiency by blowing air toward the pins 81*b*. Although the exemplary embodiment describes the blower fan 82 as being secured to the vent hole 41*b* of the thawing chamber drawer 41 to thereby be integrally formed with the thawing chamber drawer 41 by way of example, alternatively, the blower fan may be secured to a rear surface of the refrigerating compartment so as to blow air into the thawing chamber through the vent hole formed at the rear side of the thawing chamber drawer.

When air blown by the blower fan 82 comes into direct contact with food, this causes uneven thawing thereof, causing deterioration in the quality of the food. To solve this problem, the exemplary embodiment provides a configuration capable of preventing air, blown by the blower fan 82, from coming into direct contact with the food.

For this, the heat-exchange plate 81, mounted to the thawing chamber drawer 41, has a size approximately corresponding to a width of the thawing chamber drawer 41. The guide member 83 to guide the blown air is located below the heat-exchange plate 81.

The thawing chamber drawer 41 is provided with supports 41*c* to support the heat-exchange plate 81. The supports 41*c* protrude inward from an inner surface of the thawing chamber drawer 41 such that the heat-exchange plate 81 is supported by the supports 41*c* to thereby be secured to the thawing chamber drawer 41.

The contact portion 81*a* of the heat-exchange plate 81 has a size corresponding to the thawing chamber drawer 41. Therefore, tight engagement between the inner surface of the thawing chamber drawer 41 and the rim of the contact portion 81*a* hermetically seals the inner rim of the thawing chamber drawer 41.

In this way, it is possible to prevent air, passing below the heat-exchange plate 81, i.e. passing through the pins 81*b*, from rising upward toward the contact portion 81*a* on which food is placed.

The guide member 83 is located between the heat-exchange plate 81 and a bottom surface of the thawing chamber drawer 41. With the provision of the guide member 83, air, which is blown by the blower fan 82 and undergoes heat exchange with the pins 81*b* of the heat-exchange plate 81 while passing through the pins 81*b*, is guided in a direction away from the heat-exchange plate 81, i.e. toward the bottom surface of the thawing chamber drawer 41.

In operation of the food heat-exchange device 60, if the blower fan 82 starts operation in a state wherein food is placed on the contact portion 81*a* of the heat-exchange plate 81, air blown by the blower fan 82 is moved toward the pins 81*b* so as to create turbulence. The creation of turbulence results in an increase in heat-exchange efficiency.

After undergoing heat exchange with the heat-exchange plate 81, the air is moved downward along a guide hole 83*a* formed in the guide member 83. Then, after the air is lowered in temperature while being moved between the guide member 83 and the lower surface of the thawing chamber drawer 41, the air is again directed toward the pins 81*b* via operation of the blower fan 82, so as to undergo heat exchange with the pins 81*b*.

Accordingly, when the food heat-exchange device 60 in accordance with the exemplary embodiment is mounted in the thawing chamber 40, the heat-exchange plate 81 provided with the pins 81*b* can enhance a thawing rate of food placed on the contact portion 81*a*.

In this case, since the guide member 83 prevents the heat-exchanged relatively high-temperature air having passed through the pins 81*b* from coming into direct contact with food, the interior and exterior of the food can maintain a relatively low temperature difference during thawing, and this can prevent deterioration of the food.

Once the air is increased in temperature while passing through the pins 81*b*, the air is guided to pass through the guide hole 83*a* so as to move between the guide member 83 and the bottom surface of the thawing chamber drawer 41, thereby being decreased in temperature. Then, the air is again directed to the pins 81*b*, resulting in an enhanced thawing rate.

In addition, with the use of the heat-exchange plate 81 provided at the lower surface thereof with the pins 81*b* to thereby achieve high heat-exchange efficiency, there is no need for a separate heating source for thawing of food and consequently, frozen food can be thawed with minimized consumption of power.

Figure 7A:
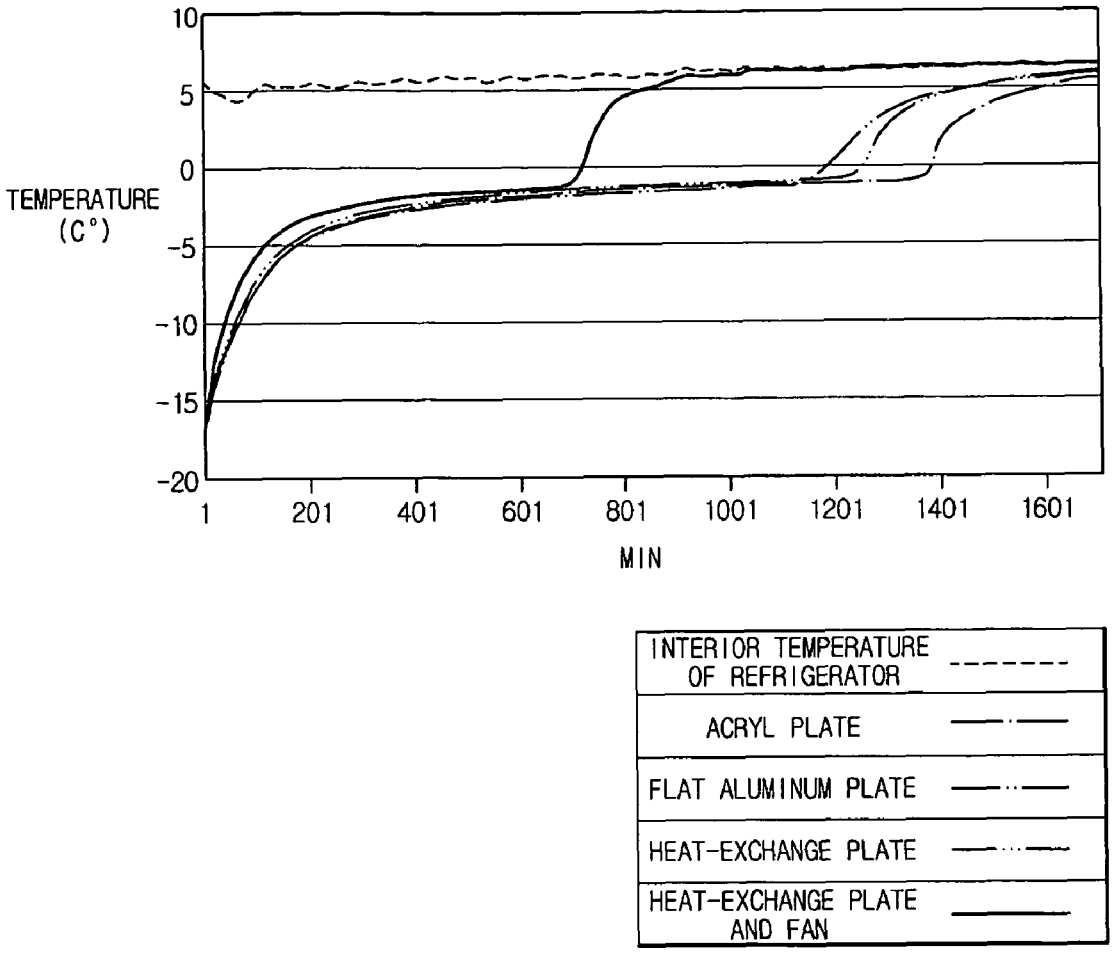
FIGS. 7A and 7B are graphs illustrating comparative results of a food thawing experiment using a food heat-exchange device according to the exemplary embodiment of the present invention and a conventional device.
Figure 7B:
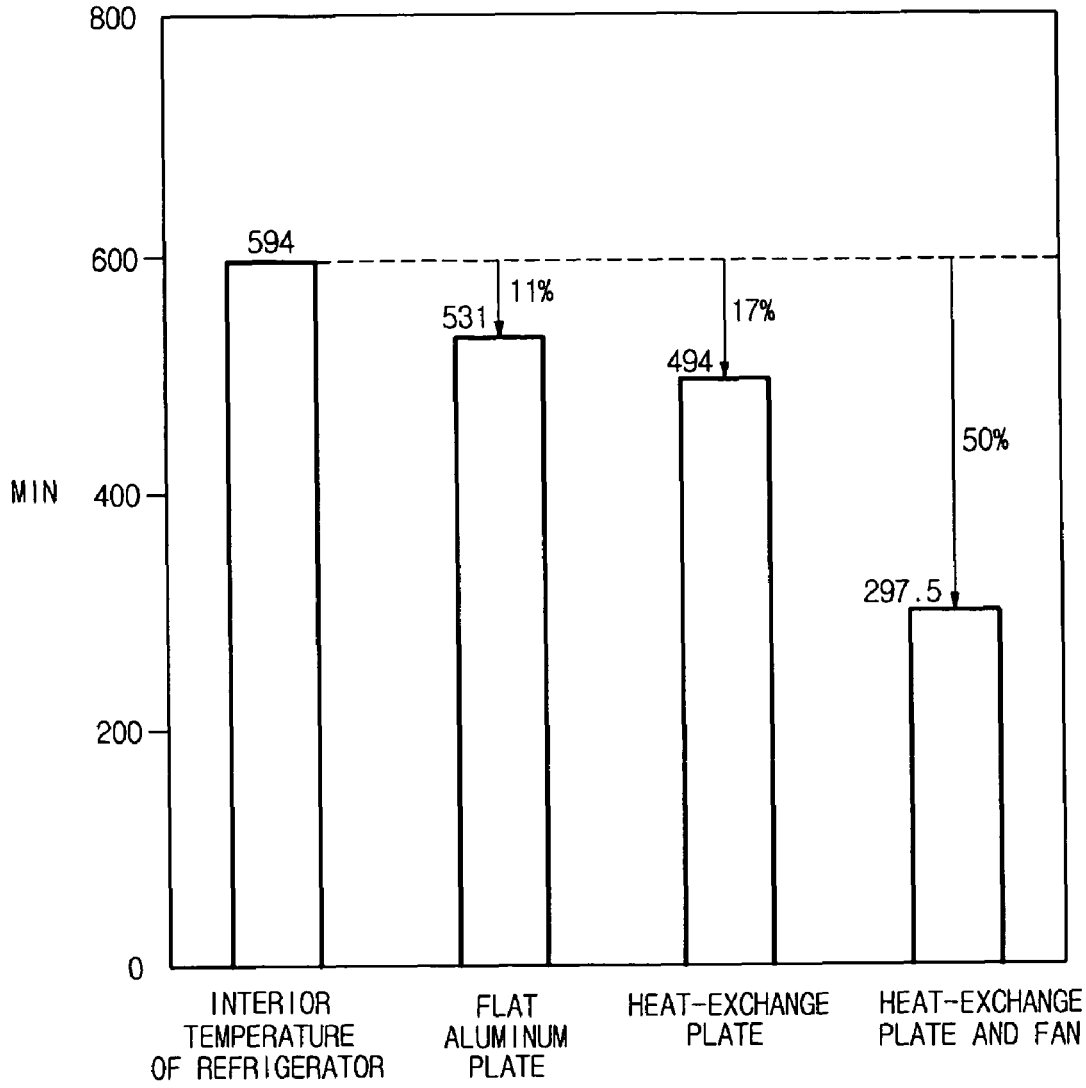

FIGS. 7A and 7B are graphs illustrating comparative results of a food thawing experiment using the food heat-exchange device according to the exemplary embodiment of the present invention and a conventional device.

In the experiment, the contact portion of the heat-exchange plate having a size of 100 mm×150 mm was used and the food was meat having a thickness of about 2.5 cm.

The graph of FIG. 7A illustrates temperature variations upon thawing, which are measured, respectively, with respect to different cases wherein frozen meat, in which a thermocouple (not shown) was centrally inserted, was disposed on an acryl plate that is generally used to form a shelf, etc., wherein the meat was disposed on a flat aluminum plate mounted in the thawing chamber, wherein the meat was disposed on the heat-exchange plate in accordance with the exemplary embodiment, and wherein the meat was disposed on the heat-exchange plate under operation of the blower fan in accordance with the exemplary embodiment.

It will be appreciated from FIG. 7A that, upon thawing of food, the flat aluminum plate has a faster thawing rate than the acryl plate, and the heat-exchange plate in accordance with the exemplary embodiment has a faster thawing rate than the flat aluminum plate.

Further, it will be appreciated that using the heat-exchange plate under operation of the blower fan has a faster thawing rate than using only the heat-exchange plate.

FIG. 7B illustrates times required for food to pass a temperature band from −5° C. to 0° C. in the above-described respective different cases. It will be appreciated that using the heat-exchange plate in accordance with the exemplary embodiment can achieve a thawing rate approximately 17% better than when using the conventional acryl plate. Further, it will be appreciated that using the heat-exchange plate under operation of the blower fan achieve a thawing rate approximately 50% better than using the conventional acryl plate.

In summary, although using the heat-exchange plate in accordance with the exemplary embodiment without a separate heating source can achieve a better thawing rate than when using conventional materials, additionally operating the blower fan can achieve greater effects.

Next, the case wherein the food heat-exchange device 70 included in the refrigerator in accordance with the exemplary embodiment is mounted in the rapid-freezing chamber 50 will be described.

The food heat-exchange device 70 mounted in the rapid-freezing chamber 50, i.e. the rapid-freezing device 70 has a configuration substantially identical to the heat-exchange device mounted 60 mounted in the thawing chamber 40, i.e. the thawing device 60. Since the food heat-exchange device mounted in the thawing chamber 40 is described above, hereinafter, only different parts from the food heat-exchange device mounted in the thawing chamber 40 will be described and description of the same configuration will be omitted.

As shown in FIGS. 3 and 5, the side and bottom of the rapid-freezing chamber 50 may be defined by a rapid-freezing chamber drawer 51 to enable slidable opening/closing of the rapid-freezing chamber 50. The top of the rapid-freezing chamber 50 may be defined by the shelf 19*a* in the freezing compartment 12.

The rapid-freezing chamber drawer 51 is formed at a front side thereof with a grip portion 51*a* and at a rear side thereof with a vent hole 51*b* to enable circulation of air between the freezing compartment 12 and the rapid-freezing chamber 50. In this case, the vent hole 51*b* is provided at a position corresponding to one of the second outlets 32 of the freezing duct 30.

The rapid-freezing device 70, provided in the rapid-freezing chamber 50, may include a heat-exchange plate 91 having a contact part 91*a* to come into contact with food so as to facilitate heat-exchange of the food, a blower fan 92 to enhance heat-exchange performance of the heat-exchange plate 91, and a guide member 93 to guide air moved by the blower fan 92.

Both the heat-exchange plate 91 and guide member 93 have the same configurations as those of the food heat-exchange device functioning as the thawing device and therefore, description thereof will be omitted.

The blower fan 92 may be secured to the second outlet 32 of the freezing duct 30, differently from the thawing device.

Upon operation of the blower fan 92, cold air in the freezing path 31, produced via heat exchange with the evaporator 16, is directly moved to the pins 81*b*, thereby being heat-exchanged with the heat-exchange plate 91 with an enhanced heat-exchange efficiency.

Although the rapid-freezing chamber 50 in accordance with the exemplary embodiment is configured such that the cold air, heat-exchanged with the evaporator 16, is guided to pins 91*b* so as to facilitate heat-exchange with the heat-exchange plate 91, of course, another configuration not using cold air from the evaporator 16, for example, a configuration wherein the blower fan 92 is mounted to the rapid-freezing chamber drawer 51 to circulate air in the rapid-freezing chamber 50 for rapid-freezing of food is also possible. The rapid-freezing chamber drawer includes a group 51*a*, a vent hole 51*b* and supports 51*c*.

Figure 8A:
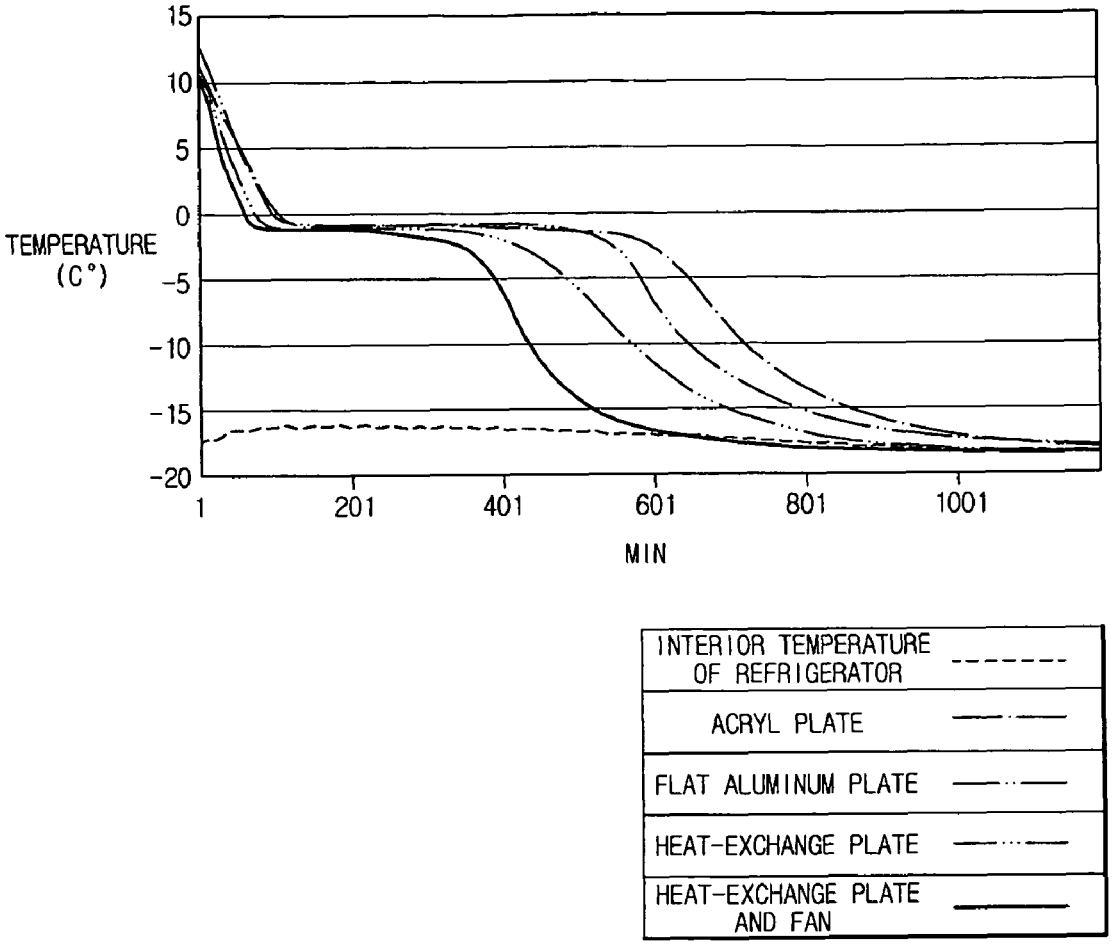
FIGS. 8A and 8B are graphs illustrating comparative results of a food rapid-freezing experiment using a food heat-exchange device according to the exemplary embodiment of the present invention and a conventional device, respectively.
Figure 8B:
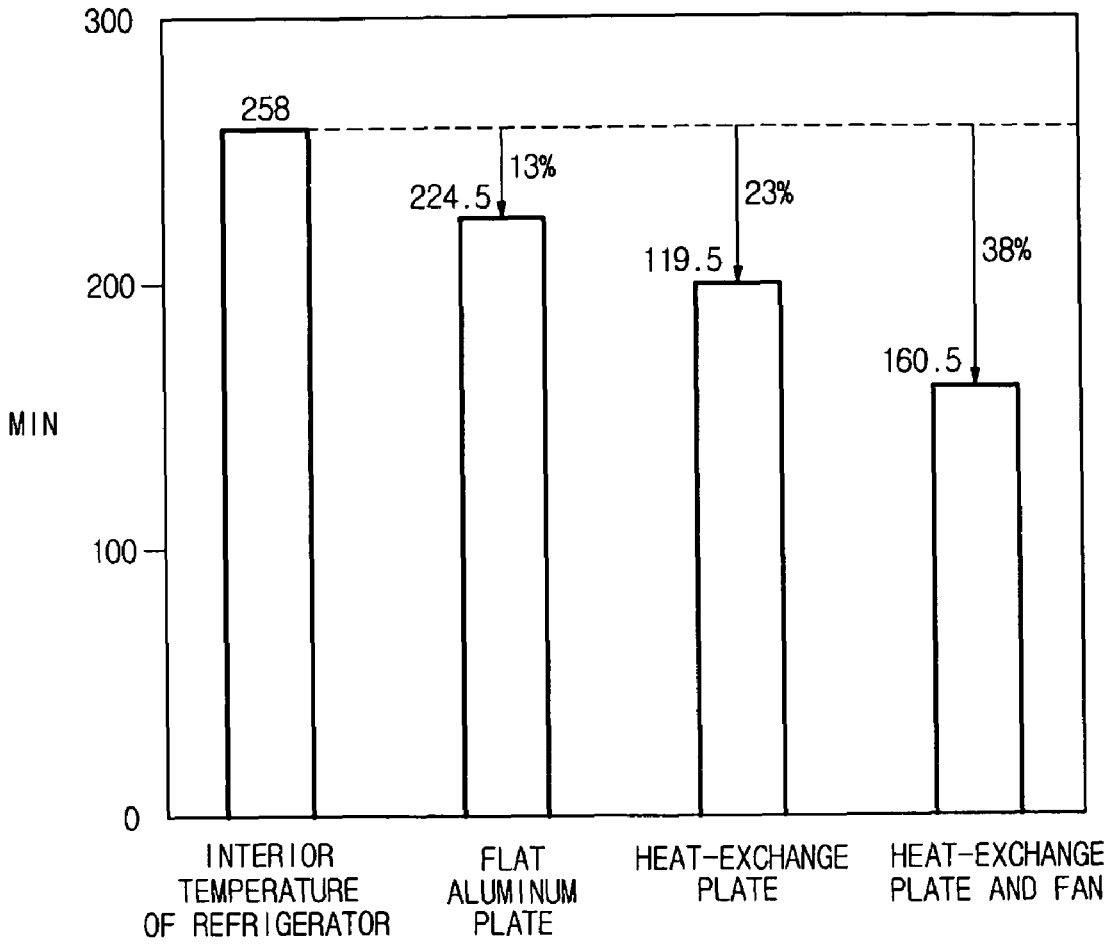

FIGS. 8A and 8B are graphs illustrating comparative results of a food rapid-freezing experiment using a food heat-exchange device according to the exemplary embodiment of the present invention and a conventional device.

The experiment was performed using the same heat-exchange plate and the same food as those used in the thawing experiment.

It will be appreciated from FIG. 8A that, upon rapid-freezing of food, the flat aluminum plate has a faster freezing rate than the acryl plate, and the heat-exchange plate in accordance with the exemplary embodiment has a faster freezing rate than the flat aluminum plate.

Further, it will be appreciated that using the heat-exchange plate under operation of the blower fan has a faster freezing rate than using only the heat-exchange plate.

FIG. 8B illustrates times required for food to pass a temperature band from −5° C. to 0° C. in the above-described respective different cases. It will be appreciated that using the heat-exchange plate in accordance with the exemplary embodiment can achieve a freezing rate approximately 23% better than when using the conventional acryl plate. Further, it will be appreciated that using the heat-exchange plate under operation of the blower fan can achieve a freezing rate approximately 38% better than when using the acryl plate.

Note that using cold air heat-exchanged with the evaporator can achieve a better freezing rate than when not using the cold air from the evaporator.

Although the above-described exemplary embodiment describes a Side-by-Side (SBS) refrigerator by way of example, naturally, the present general inventive concept is applicable to a Top-Mounted-Freezer (TMF), Bottom-Mounted-Freezer (BMF) and Kimchi refrigerators. Further, in a refrigerator having a variable temperature chamber wherein a temperature is variable between a temperature above zero and a temperature below zero, the food heat-exchange device mounted in the variable temperature chamber can function as a thawing device when the variable temperature room has a temperature above zero, whereas can function as a rapid-freezing device when the variable temperature chamber has a temperature below zero.

As is apparent from the above description, in a food heat-exchange device and a refrigerator having the same according to the exemplary embodiment of the present invention, when the food heat-exchange device is provided in a thawing chamber or rapid-freezing chamber, a heat-exchange plate having pins can enhance a thawing rate or freezing rate of food placed on a contact portion of the heat-exchange plate.

In addition, with the use of a guide member capable of preventing relatively high-temperature air, heat-exchanged with the pins, from coming into direct contact with food, it is possible to maintain a relatively low temperature difference between the interior and exterior of food, preventing deterioration of food.

Although an exemplary embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A food heat-exchange drawer of a refrigerator, comprising:

a heat-exchange plate installed in the drawer of the refrigerator and including a contact portion provided at a first surface of the heat-exchange plate to come into contact with food and a pin provided at a second surface of the heat-exchange plate to facilitate heat-exchange.

2. The drawer according to claim 1, further comprising:

a blower fan to blow air toward the pin.

3. The drawer according to claim 2, wherein the contact portion and the pin are separated from each other, to prevent the air blown by the blower fan from coming into contact with the food.

4. The drawer according to claim 2, further comprising:

a guide member to guide the air blown by the blower fan such that the air is guided in a direction away from the heat-exchange plate after passing the pin.

5. The drawer according to claim 1, wherein the refrigerator includes a refrigerating compartment and a freezing compartment, in which the food is stored, and wherein the heat-exchange plate is mounted in at least one of the refrigerating compartment and the freezing compartment.

6. A refrigerator comprising:

a body defining a storage compartment; and a food heat-exchange drawer mounted in the storage compartment and used to enable thawing or rapid-freezing of food, wherein the food heat-exchange drawer includes a heat-exchange plate, the heat-exchange plate including a contact portion provided at a first surface of the heat-exchange device to come into contact with food and a pin provided at a second surface of the heat-exchange device to facilitate heat-exchange.

7. The refrigerator according to claim 6, wherein the food heat-exchange drawer further includes a blower fan to blow air toward the pin of the heat-exchange plate.

8. The refrigerator according to claim 6, wherein the storage compartment contains a guide portion to guide entrance and exit of the heat-exchange plate while supporting the heat-exchange plate.

9. The refrigerator according to claim 6, further comprising:

a shelf provided in the storage compartment, wherein the shelf includes a receptacle in which the heat-exchange drawer is received.

10. The refrigerator according to claim 6, wherein the body further defines a rapid-freezing chamber or thawing chamber in which the food heat-exchange drawer is received, the rapid-freezing chamber or thawing chamber being separated from the storage compartment for thawing or rapid-freezing of food.

11. The refrigerator according to claim 7, wherein the food heat-exchange drawer further includes a guide member to guide the air blown by the blower fan such that the air is guided in a direction away from the heat-exchange plate after passing the pin.

12. The refrigerator according to claim 6, wherein the storage compartment includes a freezing compartment in which the food is frozen and stored, and wherein the food heat-exchange drawer is a rapid-freezing device provided in the freezing compartment and used to rapidly freeze the food on the contact portion.

13. The refrigerator according to claim 6, wherein the storage compartment includes a refrigerating compartment in which the food is kept cool, and wherein the food heat-exchange drawer is a thawing device provided in the refrigerating compartment and used to thaw the food on the contact portion without a separate heating source.

14. A refrigerator comprising:

a first storage compartment having a temperature of less than 0° C.;

a second storage compartment having a temperature of more than 0° C.;

a rapid-freezing plate provided in the first storage compartment and formed, at a first surface thereof, with a contact portion to come into contact with food and at a second surface thereof, with a pin to facilitate heat-exchange; and a thawing plate provided in the second storage compartment and formed, at a first surface thereof, with a contact portion to come into contact with the food and at a second surface thereof, with a pin to facilitate heat-exchange.

15. A refrigerator comprising:

a variable temperature drawer in which a temperature is variable between a temperature above zero and a temperature below zero;

a heat-exchange plate mounted in the variable temperature drawer and formed, at a first surface thereof, with a contact portion to come into contact with food and at a second surface thereof, with a pin to facilitate heat-exchange, wherein the heat-exchange plate is used to thaw the food when the temperature of the variable temperature room is above zero, and to rapidly freeze the food when the temperature of the variable temperature room is below zero.

16. The refrigerator according to claim 15, further comprising:

a blower fan to blow air toward the pin so as to enhance heat exchange of the heat-exchange plate.

* * * * *